US007669588B2

(12) United States Patent
Maeda

(10) Patent No.: US 7,669,588 B2
(45) Date of Patent: Mar. 2, 2010

(54) ROTARY CLIP ROTATION FOR AIR GUN

(75) Inventor: Tetsuo Maeda, Tokyo (JP)

(73) Assignee: Maruzen Company Ltd., Tokyo (JP)

( * ) Notice: Subject to any disclaimer, the term of this patent is extended or adjusted under 35 U.S.C. 154(b) by 0 days.

(21) Appl. No.: 12/069,000

(22) Filed: Feb. 14, 2008

(65) Prior Publication Data

US 2009/0056692 A1 Mar. 5, 2009

(30) Foreign Application Priority Data

Aug. 31, 2007 (JP) ..... 2007-225265

(51) Int. Cl.
*F41B 11/00* (2006.01)

(52) U.S. Cl. ..... 124/74; 42/67; 42/59; 42/65; 42/62

(58) Field of Classification Search ..... 124/74; 42/67, 59, 65, 62
See application file for complete search history.

(56) References Cited

U.S. PATENT DOCUMENTS 3,227,148 A * 1/1966 Spack ..... 124/76
5,160,795 A 11/1992 Milliman
5,400,536 A 3/1995 Milliman
5,704,150 A * 1/1998 Milliman ..... 42/67
6,112,734 A * 9/2000 Kunimoto ..... 124/73
6,745,755 B2 * 6/2004 Piccini ..... 124/49
7,159,584 B2 * 1/2007 Maeda et al. ..... 124/41.1

* cited by examiner

*Primary Examiner*—Troy Chambers
*Assistant Examiner*—Samir Abdosh
(74) *Attorney, Agent, or Firm*—Rader, Fishman & Grauer, PLLC

(57) ABSTRACT

A rotary clip rotation mechanism for an air gun, having a nail for engaging with a nail engagement section provided in the rotary clip and causing rotation of a rotary clip, comprises an L-shaped arm, capable of rotating about an arm shaft, with a muzzle side end opening section formed from a curved surface section; an arm elastic section provided at a position contacting the tip of the curved surface section of the L-shaped arm, a nail support arm provided so as to rotate on a gun rear end side of the L-shaped arm by means of a connecting elastic section, and a nail urged in the direction of the tip end by a nail elastic section provided on a tip of the nail support arm.

2 Claims, 7 Drawing Sheets

ROTARY CLIP ROTATION FOR AIR GUN

BACKGROUND OF THE INVENTION

1. Field of the Invention

This invention relates to a rotary clip (rotary cylinder, rotary magazine) rotation mechanism for an air gun.

2. Description of the Related Art

As shown in FIG. 11, a rotary clip of an air gun is provided with 6 to 8 circular bores (bullet containment sections) capable of being loaded with a single bullet of BB shot or pellet shot, and the bores are rotated to continuously fire bullets.

Generally, an air gun rotary clip is provided at one or both ends of a substantially rectangular solid shaped magazine body of a magazine, and this magazine is loaded by inserting into a magazine holding section formed from a cavity in the air gun body.

A magazine that has been inserted into the magazine holding section is ejected from the magazine holding section once all bullets contained in the rotary clip bores have been fired, and after reloading the empty bores with bullets it is fitted into the magazine holding section.

A rotary clip loaded into the air gun body is rotated by a rotation member for rotating the rotary clip, but there are occasions where a situation arises where it becomes impossible to rotate the rotary clip due to a bullet remaining between the bore of the rotary clip and the barrel, etc. In this type of situation, if an attempt is made to force the rotary clip to rotate, there is a danger of the mechanism for rotating the rotary clip, or the rotary clip itself, being damaged. In order to prevent this type of damage, there has been known a related art rotary clip rotation mechanism constructed as follows.

As related art 1, by constructing the whole of a mechanism for rotating the rotary clip of a material having comparatively high pliability, such as plastic, for example, damage to the rotary clip rotation mechanism or the rotary clip itself is avoided by deformation such as bending of the members constituting the rotation mechanism at the time of unreasonable force on the rotary clip (U.S. Pat. No. 5,160,795, U.S. Pat. No. 5,400,536, U.S. Pat. No. 5,704,150).

As related art 2, there is a mechanism that makes a tip member (referred to in the following as a nail) of a member for rotating the rotary clip movable, and causing the nail to move in an arc with a rotational axis as a center, to rotate the rotary clip. This rotation mechanism is provided with a spring between the nail and a member for supporting the nail, and the nail is urged in a direction to rotate the rotary clip. When a state then arises where the rotary clip can not be rotated, the nail is rotated about the rotational axis against the urging force of the spring to release engagement with the rotary clip, avoiding damage to the rotary clip rotation mechanism and the rotary clip itself.

Patent Publication 1: U.S. Pat. No. 5,160,795

Patent Publication 2: U.S. Pat. No. 5,400,536

Patent Publication 3: U.S. Pat. No. 5,704,150

However, related art 1 has a simple structure, but synthetic resin such as plastic constituting the material has molding conditions that are easily changed according to temperature and air pressure, and there is a problem in that design of members constituting the rotary clip rotation mechanism, and selection of material and quality control, are difficult.

Also, related art 2 has fewer problems with quality control since the respective members, such as a nail of the rotary clip rotation mechanism, can be formed of a hard material such as metal. However, it is necessary to make the nail itself small in order to ensure space for the nail to move in an arc in the narrow space of the air gun body. Therefore, if the rotary clip is rotated for a long period of time with a small nail, the likelihood of degradation or damage to sections such as the nail is high, and there is a problem that the whole of the rotary clip rotation mechanism lacks durability.

SUMMARY OF THE INVENTION

In order to solve the above described problems, there has been proposed a rotary clip rotation mechanism for an air gun, having a nail for engaging with a nail engagement section provided in the rotary clip and causing rotation of a rotary clip, comprising:

an L-shaped arm, capable of rotating about an arm axis, with a muzzle side end opening section formed from a curved surface section;

an arm elastic section provided at a position contacting the tip of the curved surface section of the L-shaped arm;

a nail support arm provided so as to rotate on a gun rear end side of the L-shaped arm by means of a connecting elastic section; and a nail urged in the direction of the tip end by a nail elastic section provided on a tip of the nail support arm.

There is also proposed a rotary clip rotation mechanism for an air gun, having a nail for engaging with a nail engagement section provided in the rotary clip and causing rotation of a rotary clip, comprising:

an L-shaped arm, capable of rotating about an arm axis, with a muzzle side end opening section formed from a curved surface section;

an arm elastic section provided at a position contacting the tip of the curved surface section of the L-shaped arm;

a nail support arm provided so as to rotate on a gun rear end side of the L-shaped arm by means of a connecting elastic section; and a nail urged in the tip direction by a nail elastic section provided on the tip of the nail support arm, wherein a nail urged in the tip direction by a nail elastic section provided on the tip of the nail support arm, wherein in a normal state, a trigger arm presses against the L-shaped arm by pulling a trigger, the nail being urged in the tip direction is raised up by the nail support arm and the nail elastic section provided on the tip of the nail support arm by means of rotation of the L-shaped arm about the arm axis, and the rotary clip is possible to be rotated by the nail engaging with the nail engagement section provided in the rotary clip and being raised up, and in a rotary clip rotation not possible state, the trigger arm presses against the L-shaped arm by pulling a trigger, shaped arm rotates about the arm axis, and the nail being urged in the tip direction is raised up by the nail support arm and the nail elastic section provided inside the nail support arm by means of rotation of the L-shaped arm about the arm axis, but the rotary clip can not rotate, rotation of the L-shaped arm is absorbed by compressing a nail elastic section without raising of the nail.

According to the present invention, a rotary clip rotation mechanism is constructed of a hard member such as metal, which means that there is no need to consider temperature and air pressure at the time of molding, and design of members constituting the rotary clip rotation mechanism, and selection of materials and quality control, are easy.

A nail, being a movable member for rotating the rotary clip, has linear reciprocating movement without moving in an arc shape, as in related art 2, which means that in the event that a space in which the nail can move is widened to the same extent as in related art 2, it is possible to make the nail and respective members of the rotary clip rotation mechanism larger. As a result it is possible to suppress degradation and damage to the nail, and durability is improved compared to related art 2.

DESCRIPTION OF THE PREFERRED EMBODIMENTS

Figure 1:
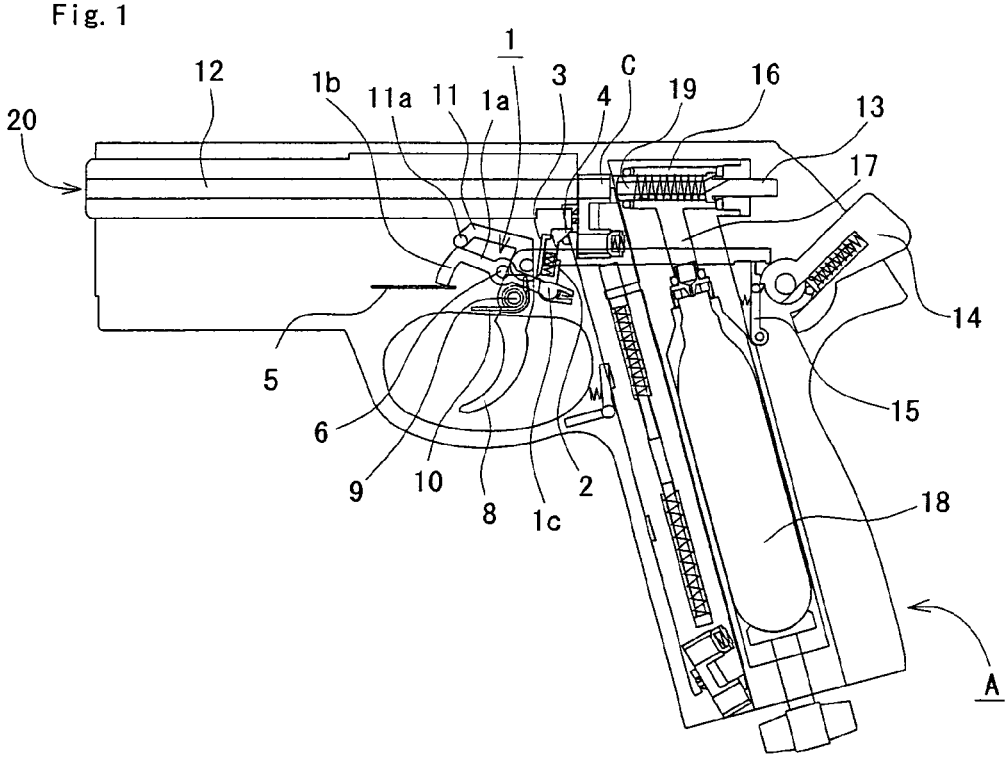
FIG. 1 is a central cross-sectional explanatory drawing of an air gun showing, in a rotary clip rotation mechanism of an air gun of an embodiment of the present invention, a state where a hammer is moved to the gun rear end side and bullets can be fired by pulling the trigger.
Figure 2:
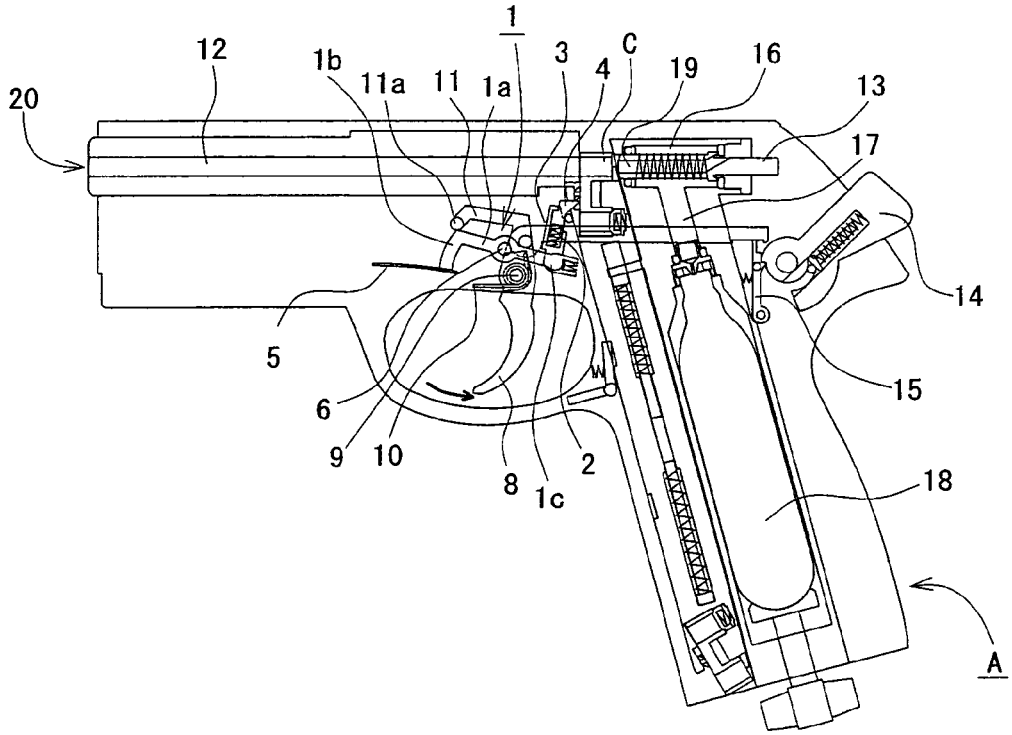
FIG. 2 is a central cross-sectional explanatory drawing of an air gun showing a state immediately after pulling a trigger from FIG. 1.
Figure 3:
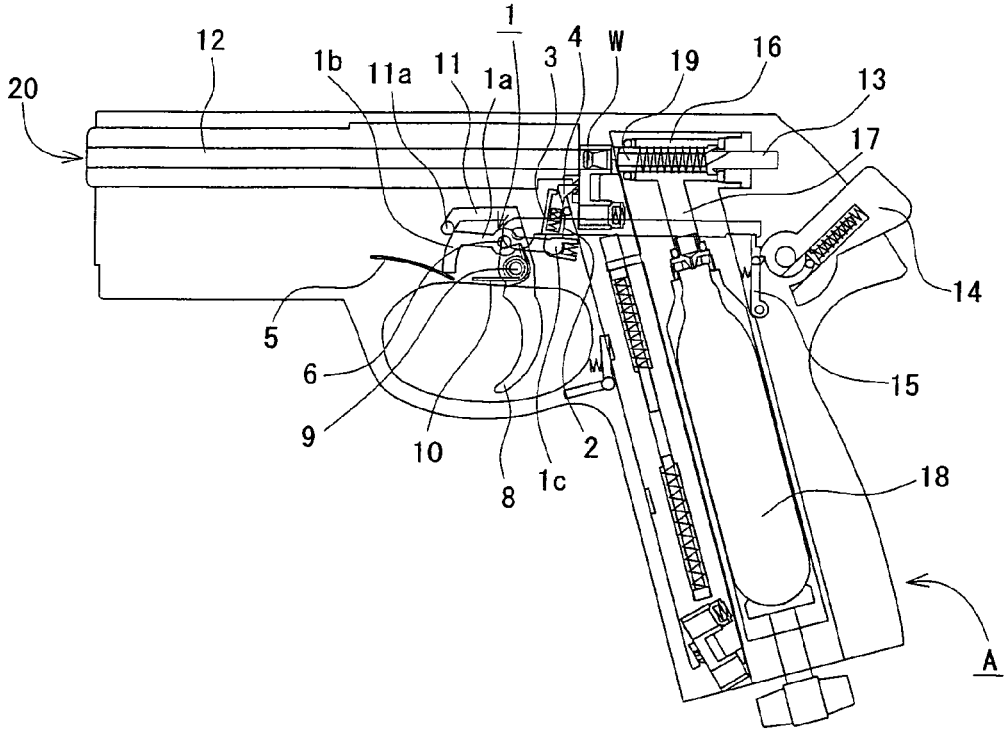
FIG. 3 is a central cross-sectional explanatory drawing of an air gun showing a state immediately after pulling a trigger further back than in FIG. 2.
Figure 4:
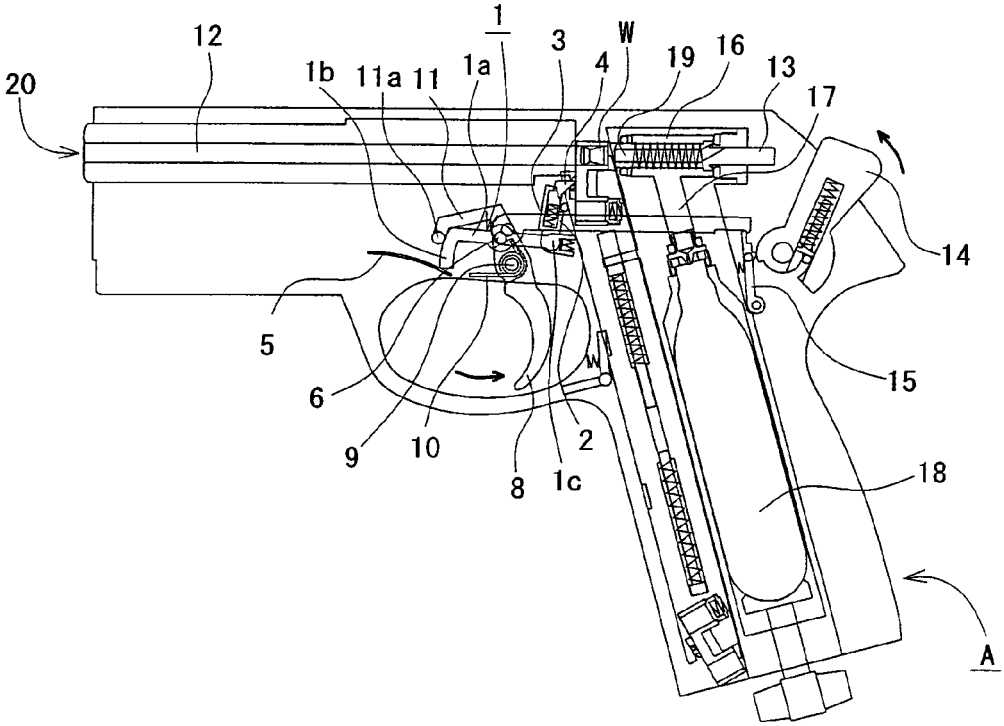
FIG. 4 is a central cross-sectional drawing of an air gun showing a state after FIG. 3, where a hammer starts to advance.
Figure 5:
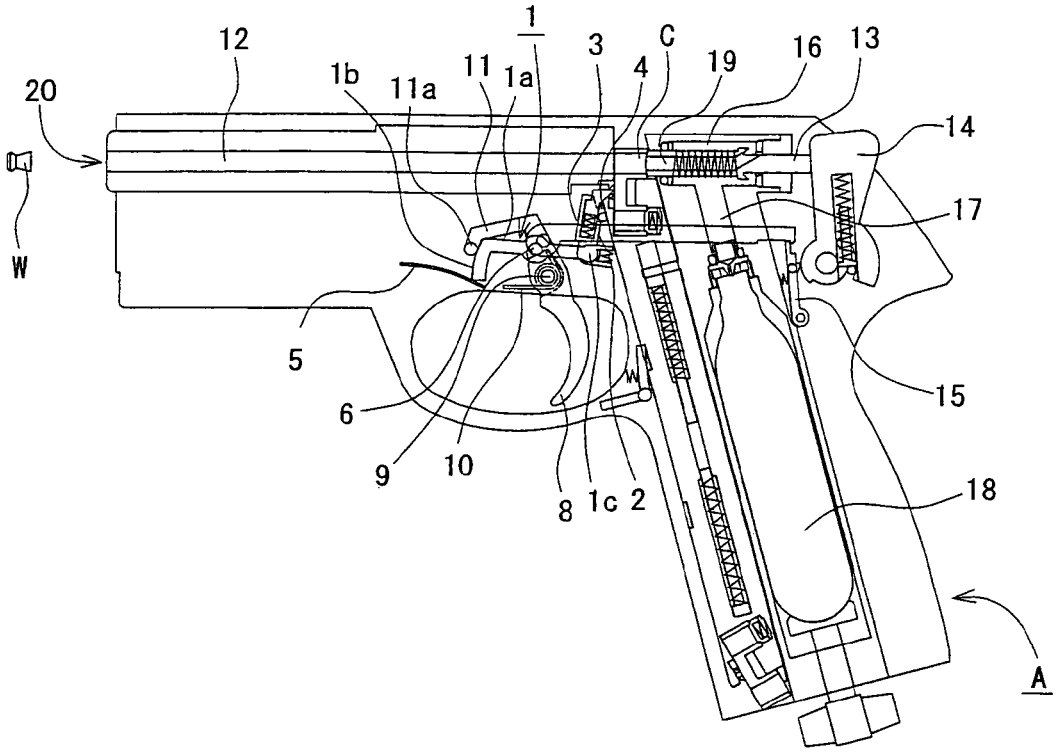
FIG. 5 is a central cross-sectional drawing of an air gun showing a state, after FIG. 4, immediately after firing a bullet.

For a rotary clip rotation mechanism for an air gun of an embodiment of the present invention, FIG. 1 to FIG. 5 show normal operation at the time of successfully rotating a rotary clip. FIG. 1 is a central cross-sectional explanatory drawing of an air gun showing, in a rotary clip rotation mechanism of an air gun of an embodiment of the present invention, a state where a hammer is moved to the gun rear end side and bullets can be fired by pulling the trigger, FIG. 2 is a central cross-sectional explanatory drawing of an air gun showing a state immediately after pulling a trigger from FIG. 1, FIG. 3 is a central cross-sectional explanatory drawing of an air gun showing a state immediately after pulling a trigger further back than FIG. 2, FIG. 4 is a central cross-sectional drawing of an air gun showing a state after FIG. 3, where a hammer starts to advance, and FIG. 5 is a central cross-sectional drawing of an air gun showing a state, after FIG. 4, immediately after firing a bullet.

Also, FIG. 6 to FIG. 10 show operation of the rotary clip rotation mechanism of an air gun in a rotary clip rotation impossible state where the rotary clip can not be rotated because a bullet (pellet shot) loaded into a bore of the rotary clip is positioned bridging across both a gun rear end of the barrel and the bore. FIG. 6 to FIG. 10 respectively correspond to FIG. 1 to FIG. 5.

Figure 10:
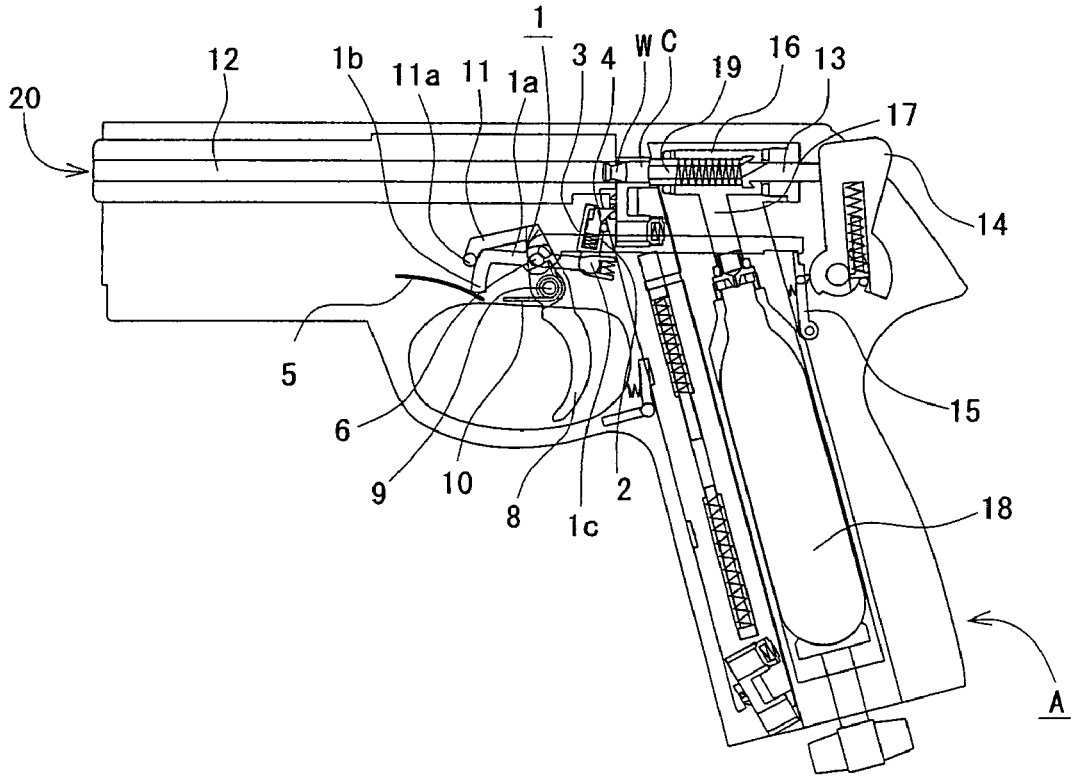
FIG. 10 is a central cross-sectional drawing of an air gun showing a state, after FIG. 9.
Figure 11:
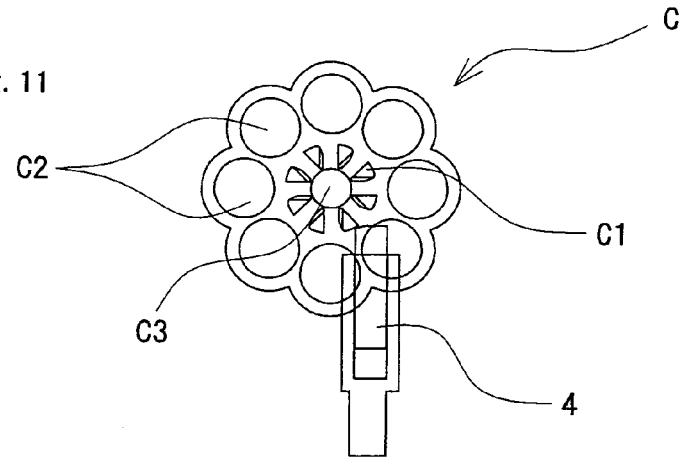
FIG. 11 is an explanatory drawing of a rotary clip looking from a muzzle side
Figure 12:
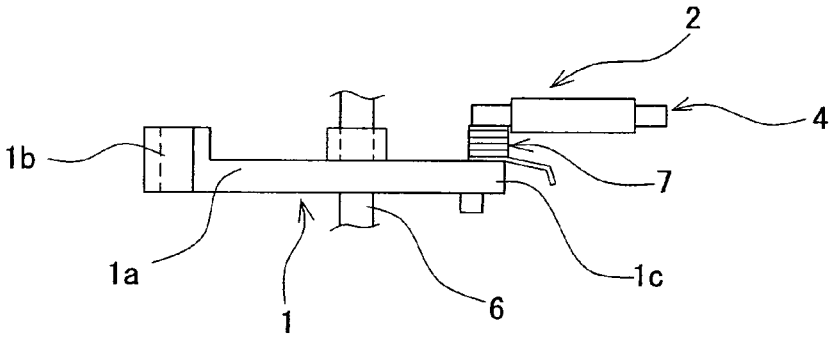
FIG. 12 is a plan view of an L-shaped arm and nail support arm of a rotary clip rotation mechanism for an air gun of an embodiment of the invention.
Figure 13:
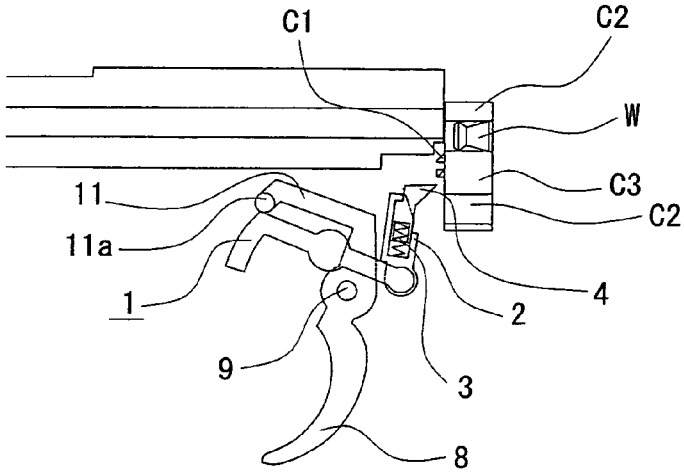
FIG. 13 is an enlarged side view of a trigger, trigger arm, L-shaped arm, nail support arm, nail spring, and nail in the state of FIG. 1.
Figure 14:
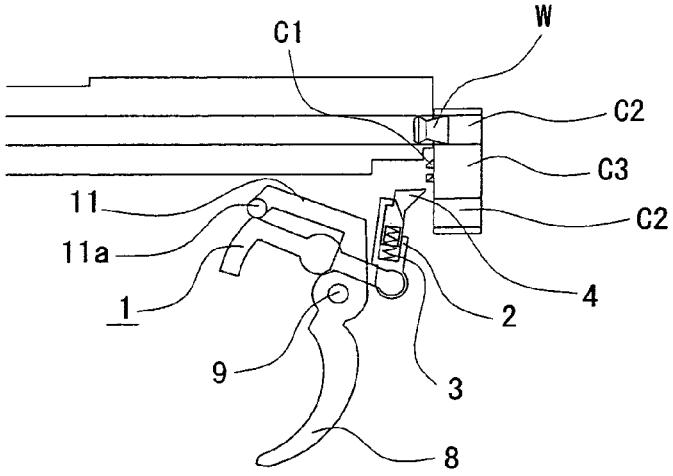
FIG. 14 is an enlarged side view of a trigger, trigger arm, L-shaped arm, nail support arm, nail spring, and nail in the state of FIG. 6.
Figure 15:
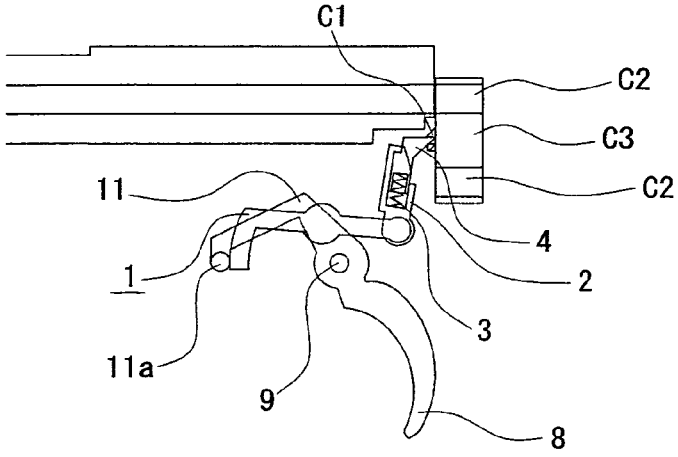
FIG. 15 is an enlarged side view showing the operating state of a trigger, trigger arm, L-shaped arm, nail support arm, nail spring, and nail in the state of FIG. 5.
Figure 16:
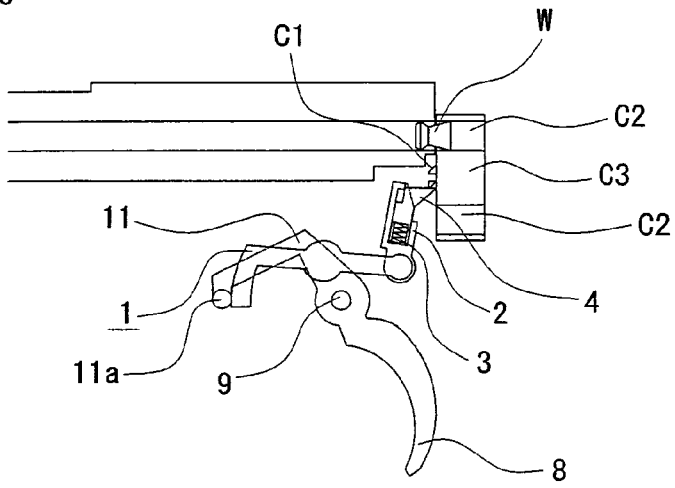
FIG. 16 is an enlarged side view showing the operating state of a trigger, trigger arm, L-shaped arm, nail support arm, nail spring, and nail in the state of FIG. 10.

FIG. 11 is an explanatory drawing of a rotary clip C looking from a muzzle side, FIG. 12 is a plan view of an L-shaped arm and nail support arm of a rotary clip rotation mechanism for an air gun of an embodiment of the invention, and FIG. 13 to FIG. 16 are enlarged side views of a trigger, trigger arm, L-shaped arm, nail support arm, nail spring and nail in the state of FIG. 1, FIG. 6, FIG. 5 and FIG. 10, respectively.

The rotary clip rotation mechanism for an air gun that is the embodiment of this invention comprises an L-shaped arm 1 having a curved surface section 1*b* capable of movement about an arm shaft 6, a nail support arm 2 provided so as to rotate on the L-shaped arm 1, a nail 4 provided on the tip of the nail support arm 2 and urged in a tip direction by a nail spring 3, and an arm spring 5 that is a plate spring provided at a position contacting the tip of the curved surface section 1*a* of the L-shaped arm 1.

The L-shaped arm 1 rotates about the arm shaft 6, but is provided with a straight rod-shaped trigger arm sliding section 1*a* from the arm shaft 6 to the muzzle side, a curved surface section 1*b* provided beneath a muzzle side end section of the trigger arm sliding section 1*a*, and part of the straight rod shaped section provided from the arm shaft 6 to the rear side (opposite the muzzle side), and is rotatably connected to a lower end of the nail support arm 2 by a rear side end section 1*c* of the straight rod-shaped section. The curved surface section 1*b* is formed as a convex curved surface with an outer surface that spreads out wider than the trigger arm sliding section 1*a*.

The rear side end section 1*c* of the L-shaped arm 1 and the lower end section 2*a* of the nail support arm 2 are connected to each other so as to rotate by a transverse connecting shaft, and are urged in the rotary clip C direction, which is the transverse direction, by a connecting spring 7 provided on the outer periphery of the connecting shaft.

The nail support arm 2 is a cylindrical body having an internal space, with a nail spring 3 being provided in the internal space so as to urge in a longitudinal direction, with one end being attached to a lower end inner section of the nail support arm 2 and a nail 4 being attached to an upper end side.

The nail 4 is a claw shaped body becoming thinner in thickness towards the upper end, with a lower section being positioned at a cylindrical body section of the nail support arm 2 and connected to the nail spring 3 at a lower end section, and an upper section projecting from a tip opening section of the nail support arm 2. The nail 4 is urged upwards by the nail spring 3, with a tip being engaged with a projection shaped nail engagement section C1 formed on the rotary clip C by the upward movement of the nail 4, and the rotary clip C is rotated.

The trigger 8 is provided capable of rotation about a trigger shaft 9, and a trigger arm 11 formed integrally with the trigger 8, being a section higher than the trigger shaft 9, is forced to rotate to the gun rear end side by the trigger spring 10. A muzzle side tip section of the trigger arm 11 is curved downwards, and a trigger arm tip section 11*a*, which is at the tip section of muzzle side tip section, makes slidable contact with the trigger arm sliding section 1*a* of the L-shaped arm 1 from above.

The rotary clip C is provided with a plurality, for example six to eight, bores capable of each holding a single bullet such as a diabolo shaped pellet or a spherical BB pellet, arranged in a ring and capable of rotation about the rotary clip shaft C3. Protrusion shaped nail engagement sections C1 the same in number as the bores C2 are provided radially at the muzzle side surface of the rotary clip C in the vicinity of the outer periphery of the rotary clip rotation shaft C3.

In the stationary state of the rotary clip C, three sections, namely a single bore C2 in the rotary clip C, the barrel 12 and a gas discharge port of a valve pin 13, are arranged in a line, and the single bore C2 is positioned between the barrel 12 and the gas discharge port of the valve pin 13.

Reference numeral 14 is a hammer, with a sear 15 separated by operation of the trigger 8, rotated to impact the valve pin 13 and release the airtight state of a valve pin air chamber 16. In this way, gas is injected from a gas canister 18 inserted into the handle section of the air gun body A through the inside of the valve pin 13 by means of the gas intake port 17, and a bullet W inside the bore C2 of the rotary clip C is fired.

Next, operation of a rotary clip rotation mechanism for an air gun of the embodiment of the present invention will be described based on FIG. 2 to FIG. 5 which are explanatory drawings of a normal state successfully rotating a rotary clip. FIG. 2 is a state where the trigger 8 has started to be pulled back. Since the trigger 8 is pulled back in the direction of the arrow, the trigger arm 11, which is at an upper part from trigger shaft 9 for rotating the about the trigger shaft 9, rotates in a counter-clockwise direction in FIG. 2, and a trigger arm tip section 11*a* presses against the trigger arm siding section 1*a* of the L-shaped arm 1, from above. If this is done, the L-shaped arm 1 also rotates in a counter-clockwise direction in FIG. 2 about the arm shaft 6, which means that the trigger arm tip section 11*a* starts to slide in the direction of the muzzle side on the trigger arm sliding section 1*a*.

As a result of rotation of the L-shaped arm 1, the tip of the curved surface section 1*b* of the L-shaped arm 1 presses the arm spring 5 from above, and the rear side end section 1*c* starts to move upwards. Together with the upward movement of the rear end section 1*c* of the L-shaped arm 1, the nail support arm 2 that is rotatably linked to the rear end section 1*c* also moves upwards, and the nail 4 provided inside the nail support arm 2 also moves upwards. The nail 4 engages with the nail engagement section C1 of the rotary clip C as a result of upward rotation of the nail 4, and as a result of the nail engagement section C1 being pressed upwards the rotary clip C starts to rotate in a counter clockwise direction viewed from the muzzle side.

FIG. 3 is a state where the trigger 8 has been pulled further in the direction of the arrow from FIG. 2, with the trigger arm tip section 11*a* sliding on the trigger arm sliding section 1*a* to the muzzle side, and finally starting to slide on the outer surface of the curved surface 1*b* that curves convexly outwards. As a result of commencement of this sliding on the outer surface of the curved section 1*b* of the trigger arm tip section 11*a*, pressing of the trigger arm tip section 11*a* towards the L-shaped arm 1 ends, rotation of the L-shaped arm 1 ends, and pressing towards the arm spring by the tip section of the curbed section 1*b* of the L-shaped arm 1 also ends.

As a result of the rotation of the L-shaped arm 1 ending, the upward movement of the nail support arm 2 and the nail 4 also ends, and therefore rotation of the rotary clip C also ends, but the next bore C2 that will be adjacent as a result of the rotation of the rotary clip C is positioned in a straight line between the barrel 12 and the gas discharge port of the valve pin 13.

FIG. 4 shows a state where the trigger 8 has been pulled further in the direction of the arrow from FIG. 3, with engagement between the sear 15 and the hammer 14 being broken, and the hammer 14 starting to rotate as shown by the arrow towards the muzzle.

FIG. 5 shows a state where the rotated hammer 14 hits the valve pin 13. In this manner, the valve pin 13 moves towards the muzzle side, and the airtight seal of valve pin air chamber 16 is broken. If the airtight seal of the valve pin air chamber 16 is broken, gas in the gas canister 18 underneath passes from the gas discharge opening 17 and through the gas passage 19 inside the valve pin 13 to press a bullet W that is inside the bore C1 inside the rotary clip C, firing the bullet W through the barrel 12 and out from the muzzle 20.

If the trigger 8 that has finished being pulled is released by the operator, it returns to the original position (position shown in FIG. 1) under the urging force of the trigger spring 10. The L-shaped arm 1 returns to its original position (position shown in FIG. 1) under the urging force of the arm spring 5. In this way, the trigger arm tip section 11*a* of the trigger arm 11 comes into contact with the upper surface of the trigger arm sliding section 1*a* of the L-shaped arm 1. The nail support arm 2 that is connected to the L-shaped arm 1 is lowered and returns to the original position shown in FIG. 1.

As a result of lowering the nail support arm 2, the nail 4 slides on the inclined surface of the nail engagement section C1, that is the radial protrusion, of the rotary clip C, and engagement between the engaged nail engagement section C1 and the nail 4 is released, and the nail 4 stops at a position where engagement is possible between the nail 4 and the next engagement nail section C1 that will be adjacent below the engaged nail engagement section C1.

Next, operation of the rotary clip rotation mechanism of an air gun of an embodiment of the invention will be described based on FIG. 6 to FIG. 10 showing a state where the rotary clip can not be rotated because a bullet W (pellet shot) loaded into a bore C2 of the rotary clip C is positioned bridging across both a gun rear end of the barrel 12 and the bore C2.

Figure 6:
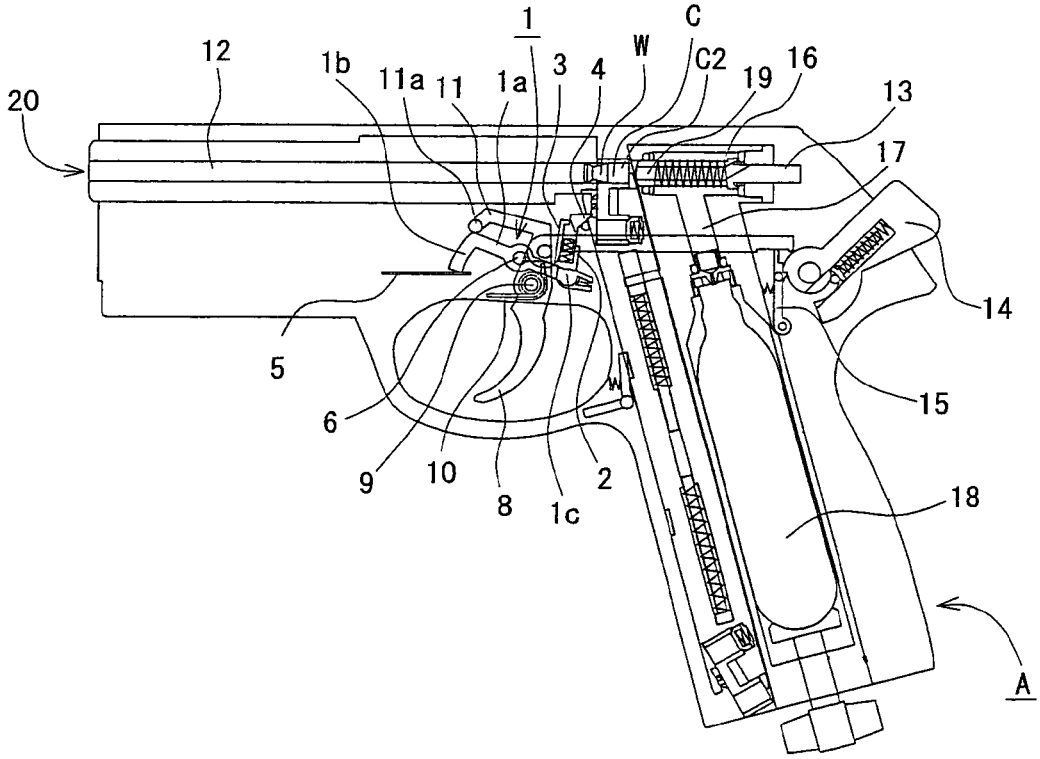
FIG. 6 is a central cross sectional explanatory drawing showing a state where, in operation of the rotary clip rotation mechanism of an air gun of an embodiment of the invention, the rotary clip can not be rotated because a bullet W (pellet shot) loaded into a bore of the rotary clip is positioned bridging across both a gun rear end of the barrel and the bore.

FIG. 6 which is corresponded to FIG. 1, shows a rotary clip rotation impossible state where a bullet W (pellet shot) loaded into a bore C2 of the rotary clip C is positioned bridging across both a gun rear end of the barrel 12 and the bore C2.

Figure 7:
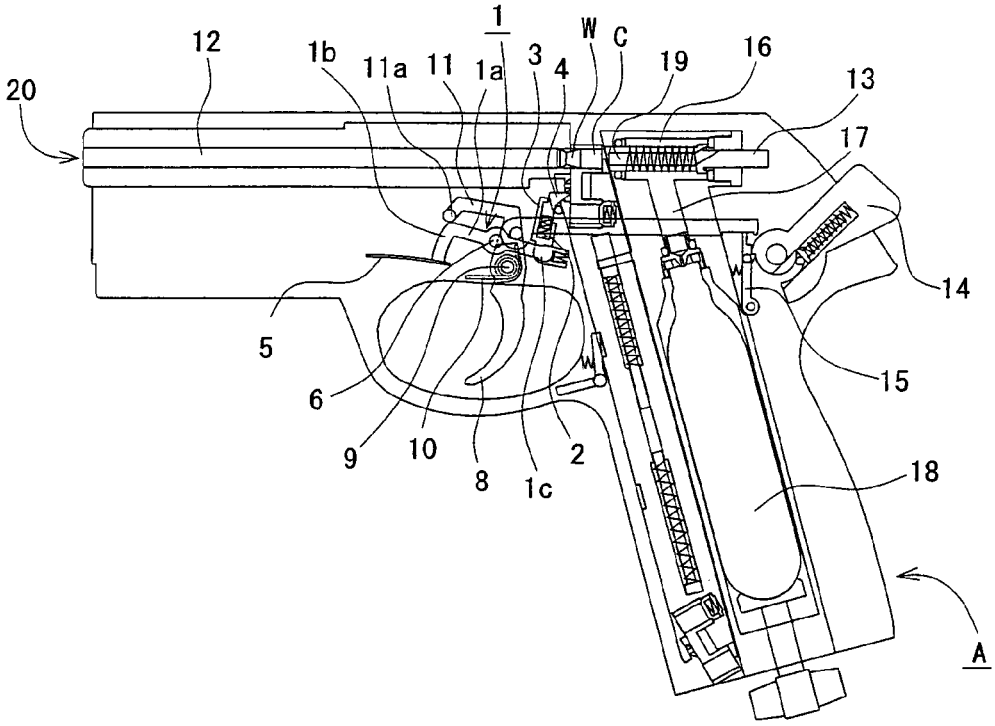
FIG. 7 is a central cross-sectional explanatory drawing of an air gun showing a state immediately after pulling a trigger from FIG. 6.

FIG. 7 is a state where the trigger 8 starts to be pulled, corresponding to FIG. 2. If the trigger 8 is pulled back in the direction of the arrow, the trigger arm 11, which is at an upper part of the trigger shaft 9 for rotating the about the trigger shaft 9, rotates in a counter-clockwise direction in FIG. 7, and a trigger arm tip section 11*a* presses against the trigger arm siding section 1*a* of the L-shaped arm 1, from above. If this is done, the L-shaped arm 1 also rotates in a counter-clockwise direction in FIG. 7 about the arm shaft 6, which means that the trigger arm tip section 11*a* starts to slide in the direction of the muzzle side on the trigger arm sliding section 1*a*.

As a result of rotation of the L-shaped arm 1, the tip of the curved surface section 1*b* of the L-shaped arm 1 presses the arm spring 5 from above, and the rear side end section 1*c* starts to move upwards. Together with the upward movement of the rear end section 1*c* of the L-shaped arm 1, the nail support arm 2 that is rotatably linked to the rear end section 1*c* also moves upwards, and the nail 4 provided inside the nail support arm 2 also moves upwards. The nail 4 engages with the nail engagement section C1 of the rotary clip C as a result of upward rotation of the nail 4, and the nail engagement section C1 is pressed further upwards.

In this way, the rotary clip C is intended to rotate in a counter clockwise direction viewed from the muzzle side, and a bullet W is positioned bridging across both a gun rear end section of the barrel 12 and the bore C2, and so the rotary clip C can not rotate. Accordingly, the nail support arm 2 also moves upwards as a result of rotation of the L-shaped arm 1, and the nail 4 provided inside the nail support arm 2 also moves upwards, but since there is engagement with the nail engagement section C1, the nail spring 3 provided between the nail 4 and the nail support arm 2, and the nail spring 3 starts to be compressed.

Figure 8:
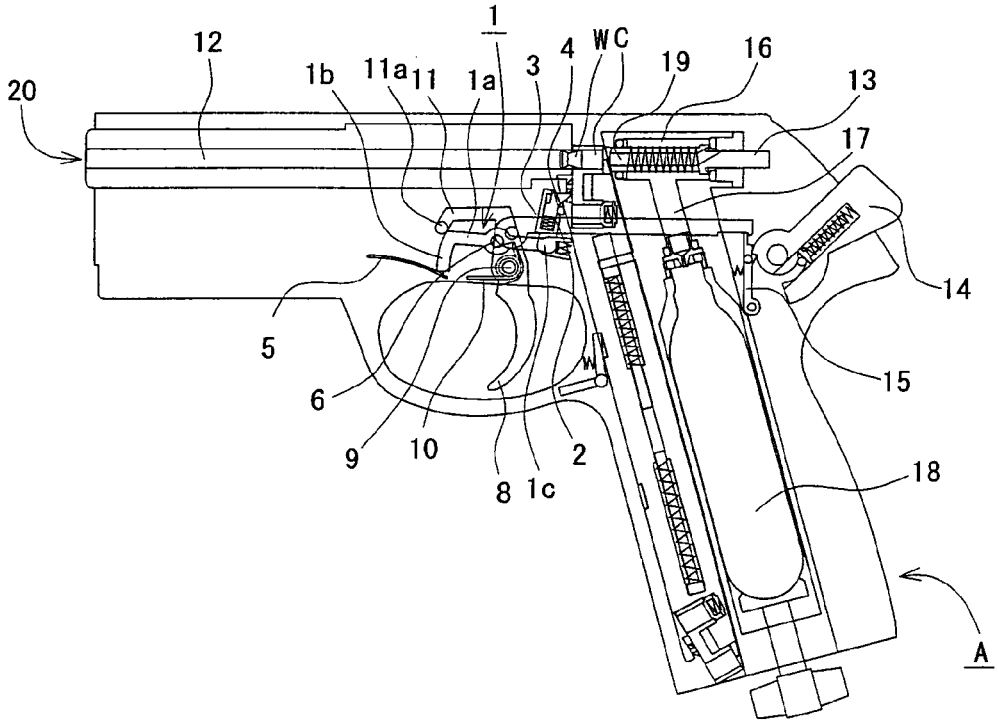
FIG. 8 is a central cross-sectional explanatory drawing of an air gun showing a state immediately after pulling a trigger further back than in FIG. 7.

FIG. 8 corresponds to FIG. 3 and is a state where the trigger 8 has been pulled further in the direction of arrow from FIG. 7, with the trigger arm tip section 11*a* sliding on the trigger arm sliding section 1*a* to the muzzle side, and finally starting to slide on the outer surface of the curved surface 1*b* that curves convexly outwards. As a result of commencement of this sliding on the outer surface of the curved section 1*b* of the trigger arm tip section 11*a*, pressing of the trigger arm tip section 11*a* towards the L-shaped arm 1 ends, rotation of the L-shaped arm 1 ends, and pressing towards the arm spring 5 by the tip section of the curved section 1*b* of the L-shaped arm 1 also ends.

As a result of rotation of the L-shaped arm 1 ending, upward movement of the nail support arm 2 and the nail 4 also end, and as a result compression of the nail spring 3 also ends.

Figure 9:
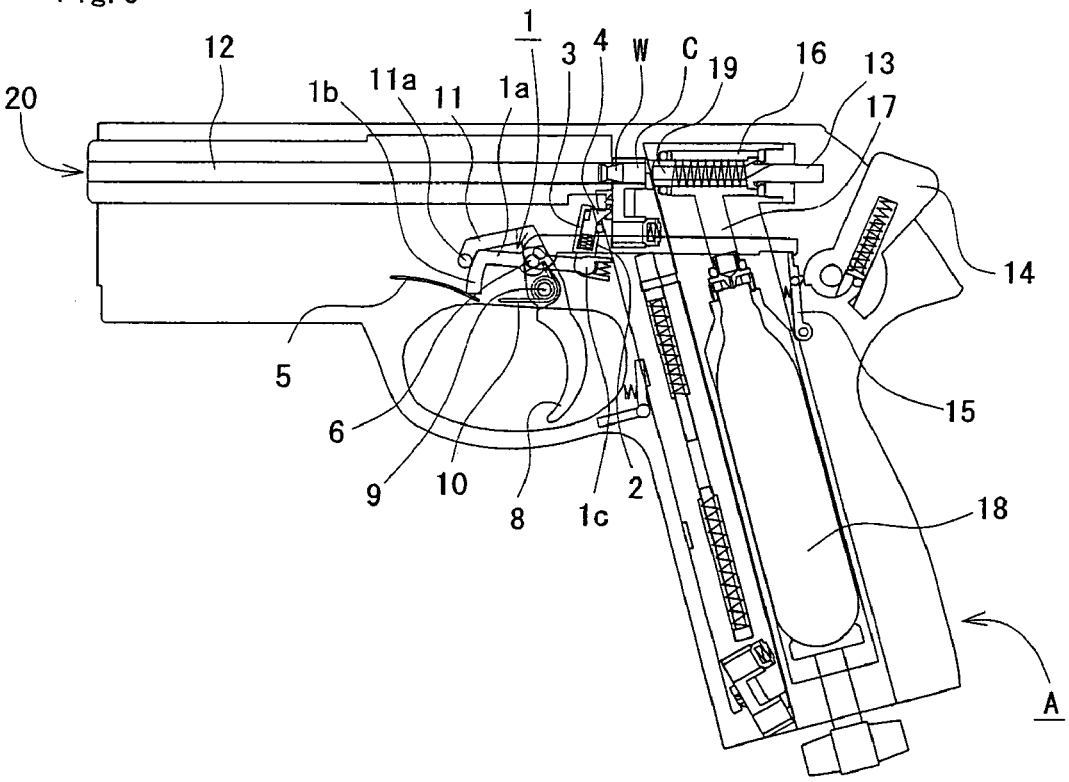
FIG. 9 is a central cross-sectional drawing of an air gun showing a state after FIG. 8, where a hammer starts to advance.

FIG. 9 corresponds to FIG. 4, and shows a state where the trigger 8 has been pulled further in the direction of the arrow from FIG. 8, with engagement between the sear 15 and the hammer 14 being broken, and the hammer 14 starting to rotate as shown by the arrow towards the muzzle.

FIG. 10 corresponds to FIG. 5, and shows a state where the rotated hammer hits the valve pin 13. In this manner, the valve pin 13 moves towards the muzzle side, and the airtight seal of valve pin air chamber 16 is broken. If the airtight seal of the valve pin air chamber 16 is broken, gas in the gas canister 18 underneath passes from the gas intake port 17 through the gas passage 19 inside the valve pin 13, and a large quantity flows into the inside of the barrel 4, but in a state where the bullet W is positioned bridging across both the gun rear end section of the barrel 12 and the bore C2, the bullet W can not be fired with the pressure of the gas.

If the trigger 8 that has finished being pulled is released by the operator, it returns to the original position (position shown in FIG. 6) under the urging force of the trigger spring 10. The L-shaped arm 1 returns to its original position (position shown in FIG. 6) under the urging force of the arm spring 5. In this way, the trigger arm tip section 1*a* of the trigger arm 11 comes into contact with the upper surface of the trigger arm sliding section 1*a* of the L-shaped arm 1. The nail support arm 2 that is connected to the L-shaped arm 1 is lowered and returns to the original position shown in FIG. 6.

Because of lowering of the nail support arm 2, compression of the nail spring 3 is released, and the nail spring 3 returns to its original length.

This invention is utilized in an air gun used in competitions, sports, etc.

What is claimed is:

1. A rotary clip rotation mechanism for an air gun, having a nail engagement section provided in a rotary clip operative to rotate, the rotary clip rotation mechanism comprising:

an L-shaped arm, capable of rotating about an arm shaft, with a muzzle side end opening section formed from a curved surface section;

a trigger arm provided at a position contacting a tip of the curved surface section of the L-shaped arm;

a nail support arm provided so as to rotate on a gun rear end side of the L-shaped arm; and a nail operative to engage the nail engagement section of the rotary clip and mounted onto the nail support arm at a tip end thereof in a slidable, resiliently biased manner urging the nail towards the nail engagement section and, wherein in a normal rotary clip rotation state, the trigger arm presses against the L-shaped arm by pulling a trigger, the nail being urged in a tip direction is raised up by the nail support arm by rotation of the L-shaped arm about an arm axis, and the rotary clip is rotated by the nail engaging with the nail engagement section of the rotary clip, and in a rotary clip stationary state, the trigger arm presses against the L-shaped arm by pulling the trigger, the L-shaped arm rotates about the arm axis, and the nail being urged in the tip direction is raised up by the nail support arm until the nail engages the nail engagement section of the rotary clip and thereafter the nail retracts into the nail support arm in a slidably resistant manner.

2. A rotary clip rotation mechanism for an air gun having a rotary clip with a nail engagement section for enabling rotation of the rotary clip, the rotary clip rotation mechanism comprising:

a trigger assembly having a trigger and a trigger arm integrally connected to the trigger, the trigger assembly connected to the air gun and operative to pivot about a trigger axis disposed between the trigger and the trigger arm, the trigger arm having a trigger arm tip section;

an L-shaped arm having an L-shaped arm portion with a curved surface section and a rear side end section integrally connected to the L-shaped arm portion and operative to pivot about an L-shaped arm axis disposed between the L-shaped arm portion and the rear side end section and spaced apart from and extending parallel to the trigger axis; and a nail assembly having a nail, a nail support arm and a nail spring, the nail support arm having a first nail support arm end portion pivotably connected to the rear side end section of the L-shaped arm and a second nail support arm end portion disposed opposite the first nail support arm end portion and configured to receive and retain the nail and the nail spring, the nail spring urging the nail towards the nail engagement section, wherein, upon pulling the trigger, the trigger arm tip section presses on the curved surface section of the L-shaped arm to move the L-shaped arm and the nail assembly in a manner that the nail moves towards the nail engagement section and, when the nail engages the nail engagement section, either:

in a normal rotary clip rotation state, the nail continues to move in engagement with the nail engagement section thereby causing the rotary clip to rotate; or in a rotary clip stationary state, the nail stops while the nail support arm continues to move such that the nail slidably retracts into the nail support arm as the nail compresses the nail spring.

* * * * *